US005855028A

United States Patent [19]

Colbert

[11] Patent Number: 5,855,028

[45] Date of Patent: Jan. 5, 1999

[54] INFLATABLE SYSTEM FOR AIDING HANDICAPPED PERSONS AND ELDERLY PERSONS INTO AND OUT OF A BATHTUB

[76] Inventor: Velda Colbert, 473 Concha St., Altadena, Calif. 91001

[21] Appl. No.: 871,690

[22] Filed: Jun. 9, 1997

[51] Int. Cl.[6] ..... A47K 3/02

[52] U.S. Cl. ..... 4/566.1; 4/563.1

[58] Field of Search ..... 4/560.1–566.1; 251/303

[56] References Cited

U.S. PATENT DOCUMENTS

| | | | |
|---|---|---|---|
| 2,809,800 | 10/1957 | Ahl | 251/303 X |
| 2,989,283 | 6/1961 | Klingler | 251/303 X |
| 3,346,885 | 10/1967 | Merriman | 4/566.1 |
| 4,254,517 | 3/1981 | Herman | 4/564.1 |

FOREIGN PATENT DOCUMENTS

| | | | |
|---|---|---|---|
| 2679753 | 2/1993 | France | 4/566.1 |
| 3024072 | 12/1993 | WIPO | 4/565.1 |

*Primary Examiner*—Charles E. Phillips

[57] ABSTRACT

An inflatable system for aiding handicapped persons and elderly persons into and out of a bathtub including an inflatable cushion adapted to hold a quantity of air therein. The cushion has an air inlet aperture and an air outlet aperture extending therein in contact with its hollow interior. An air fill hose is provided having a first end coupled with the air inlet aperture of the cushion and a second end coupleable with an air pump. An air release hose is provided having a first end coupled with the air outlet aperture of the cushion. An air release mechanism is coupled with an open second end of the air release hose.

1 Claim, 2 Drawing Sheets

INFLATABLE SYSTEM FOR AIDING HANDICAPPED PERSONS AND ELDERLY PERSONS INTO AND OUT OF A BATHTUB

BACKGROUND OF THE INVENTION

1. Field of the Invention

The present invention relates to an inflatable system for aiding handicapped persons and elderly persons into and out of a bathtub and more particularly pertains to assisting elderly and handicapped persons with respect to a bathtub with an inflatable system for aiding handicapped persons and elderly persons into and out of a bathtub.

2. Description of the Prior Art

The use of bathtub inserts is known in the prior art. More specifically, bathtub inserts heretofore devised and utilized for the purpose of raising or lowering a person in a bathtub are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,495,666 to Herman, Jr. discloses a bathtub cushion lift assembly. U.S. Pat. No. 4,768,239 to Pauley discloses a bath lift device. U.S. Pat. No. Des. 340,141 to Chapman discloses the ornamental design for an inflatable bath lift device. U.S. Pat. No. 5,103,509 to Richards discloses an apparatus for assisting physically disabled persons into and out of a bath. U.S. Pat. No. 4,932,087 to Schmidt discloses a bathtub insert for handicapped persons. U.S. Pat. No. 4,419,776 to Schmidt discloses a bathtub assembly for handicapped persons.

While these devices fulfill their respective, particular objective and requirements, the aforementioned patents do not describe an inflatable system for aiding handicapped persons and elderly persons into and out of a bathtub for assisting elderly and handicapped persons with respect to a bathtub.

In this respect, the inflatable system for aiding handicapped persons and elderly persons into and out of a bathtub according to the present invention substantially departs from the conventional concepts and designs of the prior art, and in doing so provides an apparatus primarily developed for the purpose of assisting elderly and handicapped persons with respect to a bathtub.

Therefore, it can be appreciated that there exists a continuing need for new and improved inflatable system for aiding handicapped persons and elderly persons into and out of a bathtub which can be used for assisting elderly and handicapped persons with respect to a bathtub. In this regard, the present invention substantially fulfills this need.

SUMMARY OF THE INVENTION

In the view of the foregoing disadvantages inherent in the known types of bathtub inserts now present in the prior art, the present invention provides an improved inflatable system for aiding handicapped persons and elderly persons into and out of a bathtub. As such, the general purpose of the present invention, which will be described subsequently in greater detail, is to provide a new and improved inflatable system for aiding handicapped persons and elderly persons into and out of a bathtub and method which has all the advantages of the prior art and none of the disadvantages.

To attain this, the present invention essentially comprises an inflatable cushion having a generally square configuration. The cushion includes a top wall, a bottom wall, a forward wall, a rearward wall, opposed side walls and a hollow interior. The hollow interior is adapted to hold a quantity of air therein. The top wall has a cushion pad integral therewith. The bottom wall has a non-skid surface disposed thereon. The rearward wall has an air inlet aperture extending therethrough in contact with the hollow interior. The forward wall has an air outlet aperture extending therethrough in contact with the hollow interior. An air fill hose is provided having a first end coupled with the air inlet aperture of the cushion and a second end coupleable with an air pump. An air release hose is provided having a first end coupled with the air outlet aperture of the cushion. A hand controlled air release mechanism is coupled with an open second end of the air release hose. The air release mechanism includes a hand grip disposed on the second end of the air release hose. A cover is hingedly coupled with the hand grip for selectively covering the open second end of the air release hose. A press handle is operatively coupled with the cover via a pivot hinge. A spring extends between the press handle and the hand grip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved inflatable system for aiding handicapped persons and elderly persons into and out of a bathtub which has all the advantages of the prior art bathtub inserts and none of the disadvantages.

It is another object of the present invention to provide a new and improved inflatable system for aiding handicapped persons and elderly persons into and out of a bathtub which may be easily and efficiently manufactured and marketed.

It is a further object of the present invention to provide a new and improved inflatable system for aiding handicapped persons and elderly persons into and out of a bathtub which is of durable and reliable construction.

An even further object of the present invention is to provide a new and improved inflatable system for aiding handicapped persons and elderly persons into and out of a bathtub which is susceptible of a low cost of manufacture with regard to both materials and labor, and which accordingly is then susceptible of low prices of sale to the consuming public, thereby making such an inflatable system for aiding handicapped persons and elderly persons into and out of a bathtub economically available to the buying public.

Even still another object of the present invention is to provide a new and improved inflatable system for aiding handicapped persons and elderly persons into and out of a bathtub for assisting elderly and handicapped persons with respect to a bathtub.

Lastly, it is an object of the present invention to provide a new and improved inflatable system for aiding handicapped persons and elderly persons into and out of a bathtub including an inflatable cushion adapted to hold a quantity of air therein. The cushion has an air inlet aperture and an air outlet aperture extending therein in contact with its hollow interior. An air fill hose is provided having a first end coupled with the air inlet aperture of the cushion and a second end coupleable with an air pump. An air release hose is provided having a first end coupled with the air outlet aperture of the cushion. An air release mechanism is coupled with an open second end of the air release hose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
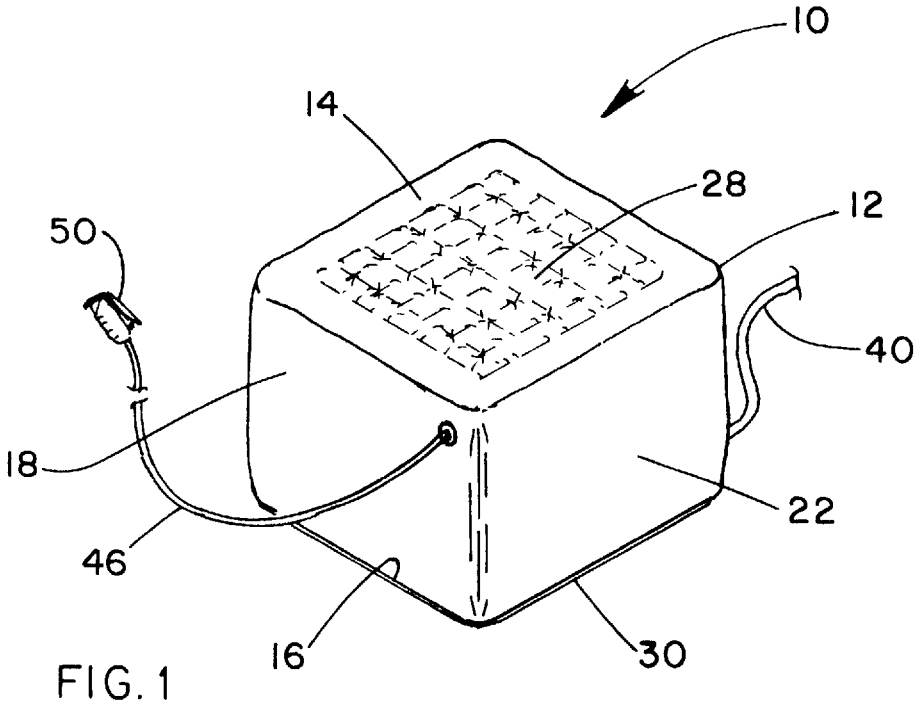
FIG. 1 is a perspective view of the preferred embodiment of the inflatable system for aiding handicapped persons and elderly persons into and out of a bathtub constructed in accordance with the principles of the present invention.
Figure 2:
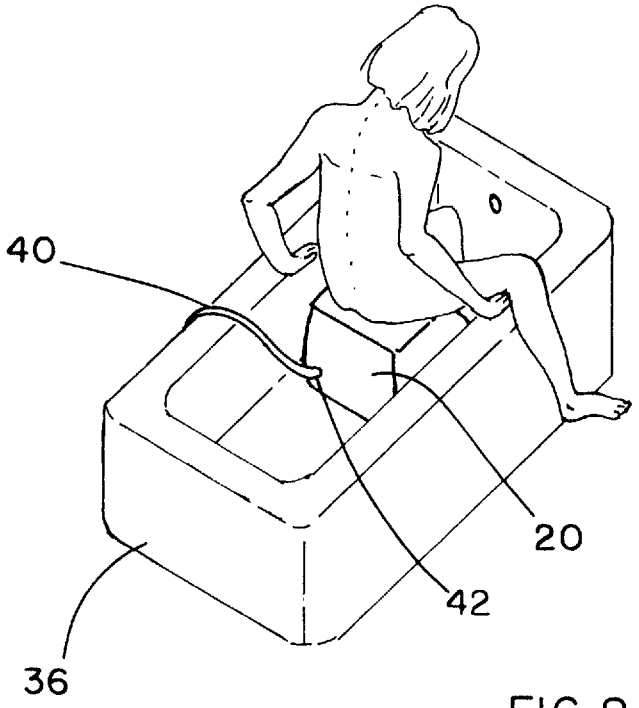
FIG. 2 is a plan perspective view of the present invention illustrated in use within a bathtub.
Figure 3:
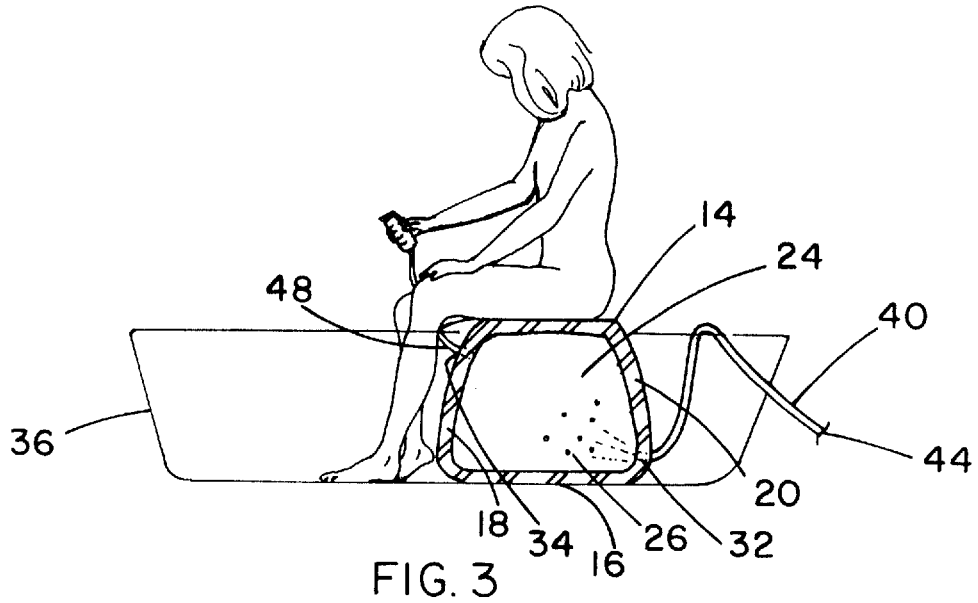
FIG. 3 is a side elevation view of the present invention illustrated in the inflated orientation.
Figure 4:
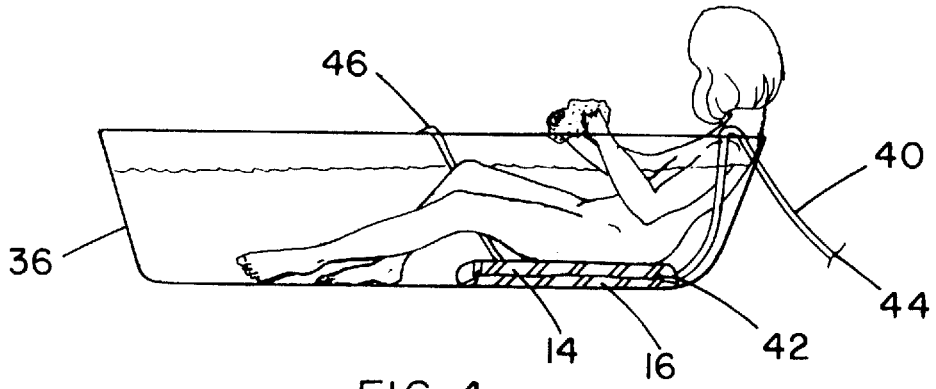
FIG. 4 is a side elevation view of the present invention illustrated in the deflated orientation.
Figure 5:
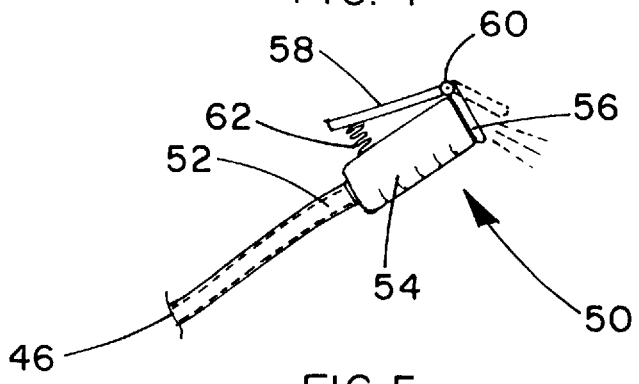
FIG. 5 is an isolated view of the hand control air release of the present invention.

With reference now to the drawings, and in particular, to FIGS. 1 through 5 thereof, the preferred embodiment of the new and improved inflatable system for aiding handicapped persons and elderly persons into and out of a bathtub embodying the principles and concepts of the present invention and generally designated by the reference number 10 will be described.

Specifically, it will be noted in the various Figures that the device relates to an inflatable system for aiding handicapped persons and elderly persons into and out of a bathtub for assisting elderly and handicapped persons with respect to a bathtub. In its broadest context, the device consists of an inflatable cushion, an air fill hose, an air release hose and a hand controlled air release mechanism. Such components are individually configured and correlated with respect to each other so as to attain the desired objective.

The system 10 includes an inflatable cushion 12 having a generally square configuration. Note FIG. 1. The cushion 12 includes a top wall 14, a bottom wall 16, a forward wall 18, a rearward wall 20, opposed side walls 22 and a hollow interior 24. The hollow interior 24 is adapted to hold a quantity of air 26 therein. The top wall 14 has a cushion pad 28 integral therewith. The bottom wall 16 has a non-skid surface 30 disposed thereon. The rearward wall 20 has an air inlet aperture 32 extending therethrough in contact with the hollow interior 24. The forward wall 18 has an air outlet aperture 34 extending therethrough in contact with the hollow interior 24. The cushion 12 is dimensioned for placement within a bathtub 36. Note FIGS. 2–4. When in an inflated orientation, FIGS. 2 and 3, the cushion 12 allows for a disabled or handicapped person to position themselves thereon in preparation of lowering themselves within the bathtub 36. The cushion 12 is ideally inflated so that the top wall 14 is equal to a height of the bathtub 36 thus allowing the person to swing over the edge of the bathtub 36 from their wheelchair. Additionally, the cushion 12 is provided with rounded edges.

An air fill hose 40 is provided having a first end 42 coupled with the air inlet aperture 32 of the cushion 12 and a second end 44 coupleable with an air pump. The air fill hose 40 is connected to the air pump, the type used could be a hand pump or a foot pump. The hand pump can be used when the user is without assistance and is required to fill the cushion by themself. The foot pump could be used when there is someone to assist and pump the cushion 12 with air.

An air release hose 46 is provided having a first end 48 coupled with the air outlet aperture 34 of the cushion 12. The air release hose 46 allows the air to exit from the cushion 12.

A hand controlled air release mechanism 50 is coupled with an open second end 52 of the air release hose 46. Note FIG. 5. The air release mechanism 50 includes a hand grip 54 disposed on the second end 52 of the air release hose 46. A cover 56 is hingedly coupled with the hand grip 54 for selectively covering the open second end 52 of the air release hose 46. A press handle 58 is operatively coupled with the cover via a pivot hinge 60. A spring 62 extends between the press handle 58 and the hand grip 54. To release air, thereby deflating the cushion 12, the press handle 58 is clutched pressing against the bias of the spring 62 thereby causing the cover 56 to lift outwardly. This will expose the open second end 52 of the air release hose 46 to permit the escape of air so that cushion 12 eventually reaches the deflated orientation and the user is positioned within the bathtub 36. Note FIG. 4. Once the press handle 58 is released, the spring 62 will bias it outwardly thereby causing the cover 56 to return to its initial position plugging the open second end 52 of the air release hose 46. Once the user has finished bathing, the cushion 12 can be refilled with air to allow the user to safely exit from the bathtub 36.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An inflatable system for aiding handicapped persons and elderly persons into and out of a bathtub comprising, in combination:

an inflatable cushion having a generally square configuration, the cushion including a top wall, a bottom wall, a forward wall, a rearward wall, opposed side walls and a hollow interior, the hollow interior adapted to hold a quantity of air therein, the top wall having a cushion pad integral therewith, the bottom wall having a non-skid surface disposed thereon, the rearward wall having an air inlet aperture extending therethrough in contact with the hollow interior, the forward wall having an air outlet aperture extending therethrough in contact with the hollow interior;

an air fill hose having a first end coupled with the air inlet aperture of the cushion and a second end coupleable with an air pump;

an air release hose having a first end coupled with the air outlet aperture of the cushion; and a hand controlled air release mechanism coupled with an open second end of the air release hose, the air release mechanism including a hand grip disposed on the second end of the air release hose, a cover hingedly coupled with the hand grip for selectively covering the open second end of the air release hose, the cover being positioned exteriorly of the open second end of the air release hose, a press handle operatively coupled with the cover via a pivot hinge, a spring extends between the press handle and the hand grip.

* * * * *